United States Patent [19]

White

[11] Patent Number: 4,779,493

[45] Date of Patent: Oct. 25, 1988

[54] COMBINATION POCKET TOOL

[76] Inventor: Joseph A. White, Rte. 3, Box 1870, Corsicana, Tex. 75110

[21] Appl. No.: 162,805

[22] Filed: Mar. 1, 1988

Related U.S. Application Data

[63] Continuation-in-part of Ser. No. 77,028, Jul. 21, 1987, abandoned, which is a continuation of Ser. No. 915,924, Oct. 6, 1986, abandoned, which is a continuation of Ser. No. 735,982, May 20, 1985, abandoned.

[51] Int. Cl.[4] ..... B25G 1/08

[52] U.S. Cl. ..... 81/438; 81/439; 81/177.4; 81/177.85

[58] Field of Search ..... 81/177.4, 177.85, 437, 81/438, 439

[56] References Cited

U.S. PATENT DOCUMENTS

| | | | |
|---|---|---|---|
| 1,456,341 | 7/1891 | Reid, Jr. . | |
| 1,325,070 | 12/1919 | Andrews . | |
| 1,448,895 | 3/1923 | Yotta . | |
| 2,476,762 | 7/1949 | Petre et al. . | |
| 2,527,492 | 10/1950 | Cleary et al. | 81/438 X |
| 2,658,766 | 11/1953 | Rock . | |
| 3,034,550 | 5/1962 | Dahl . | |
| 3,114,401 | 12/1963 | Johnson | 81/438 |
| 3,177,910 | 4/1965 | Da Silva . | |
| 3,255,792 | 6/1966 | Beck . | |
| 3,455,355 | 7/1969 | McLogan, et al. . | |
| 4,056,020 | 11/1977 | Coviello | 81/177.85 X |
| 4,273,173 | 6/1981 | Smith et al. | 81/177.4 |

FOREIGN PATENT DOCUMENTS

| | | | |
|---|---|---|---|
| 403769 | 1/1934 | United Kingdom | 81/439 |

*Primary Examiner*—Debra Meislin

*Attorney, Agent, or Firm*—Michael A. O'Neil

[57] ABSTRACT

A combination pocket tool has a shank and a handle. The shank has a tool at one end and a tool drive at the other end. The handle has a steel sleeve embedded within a hollow cavity. A first detent on the tool drive secures the tool or the tool drive within the cavity of the handle. A second detent on the tool drive assists in securing the tool drive within the cavity or secures a detachable tool to the tool drive.

4 Claims, 1 Drawing Sheet

COMBINATION POCKET TOOL

CROSS-REFERENCE TO RELATED APPLICATIONS

This application is a continuation-in-part of application Ser. No. 07/077,028, filed July 21, 1987, now abandoned, which was a continuation of application Ser. No. 06/915,924, filed Oct. 6, 1986, now abandoned, which was a continuation of application Ser. No. 06/735,982, filed May 20, 1985, now abandoned.

TECHNICAL FIELD

This invention relates generally to hand tools. In particular, the invention relates to a combination pocket tool having a handle for holding a shank having a combination of tools or tool drives on its ends.

BACKGROUND AND SUMMARY OF THE INVENTION

Over the years, various types of combination pocket tools have been designed and sold. One aspect of the numerous prior efforts in the field has been the use of a handle for holding a shaft having different tools or tool drives on each end. Some tools have had a combination of tools of different types or sizes.

The present invention provides a combination pocket tool that can be easily carried in a pants or coat pocket without damaging the garment. The tool includes a handle and a shank that has a tool, such as a screwdriver blade, integrally formed at one end. A tool drive is integrally formed on the other end of the shank. The tool drive may be a square socket drive of the type used to drive a standard set of ¼ inch sockets.

A first detent, located on the shaft, secures the tool or the tool drive within a cavity in the handle. A second detent, on the tool drive, helps to secure the tool drive within the handle when the tool is in use. When the tool is inserted into the handle, the second detent is used to secure a detachable tocl, such as a socket, on the tool drive.

BRIEF DESCRIPTION OF THE DRAWINGS

A more complete understanding of the invention may be had by reference to the following Detailed Description when taken in conjuction with the accompanying Drawings, wherein.

DETAILED DESCRIPTION

Figure 1:
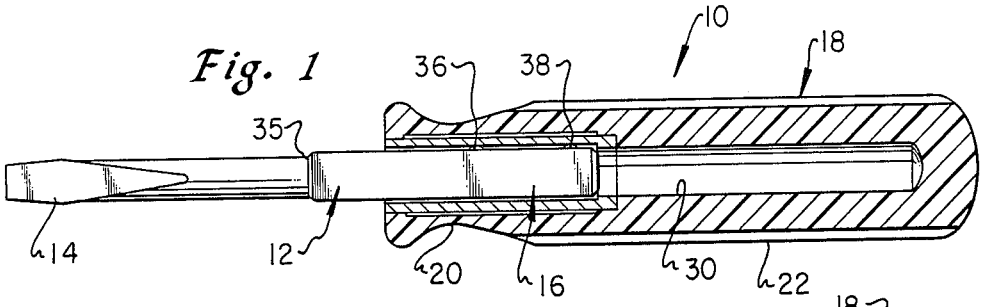
FIG. 1 is a side view of the combination pocket tool showing the tool drive secured within the handle.

The Drawings show a combination pocket tool 10 incorporating the invention. The combination pocket tool 10 includes a square shank 12 made from a tool steel or any of the various materials commonly used in the manufacture of hand tools. A tool 14, such as a screwdriver blade, is integrally formed on one end of the shank 12.

A tool drive 16 is integrally formed on the other end of the shank 12, opposite the screwdriver blade 14. The tool drive 16 is preferably square, but any non-circular drive may be utilized in the practice of the invention.

The combination pocket tool 10 also includes a handle 18 having a neck portion 20 and a lower portion 22. The handle 18 is constructed from a high strength insulated plastic commonly used for handles on hand tools. Other materials may be employed in the manufacture of the handle 18, if desired.

The lower portion 22 of the handle 18 has a plurality of external splines 24 running lengthwise of the handle 18. The neck portion 20 of the handle 18 tapers to a smaller diameter. The splines 24 and the tapered neck portion 20 are conventional in tool handle designs.

Figure 2:
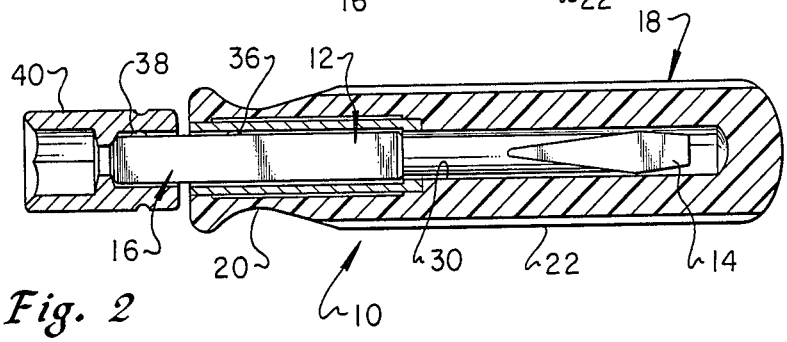
FIG. 2 is a side view of the combination pocket tool showing the screwdriver blade secured within the handle.
Figure 3:
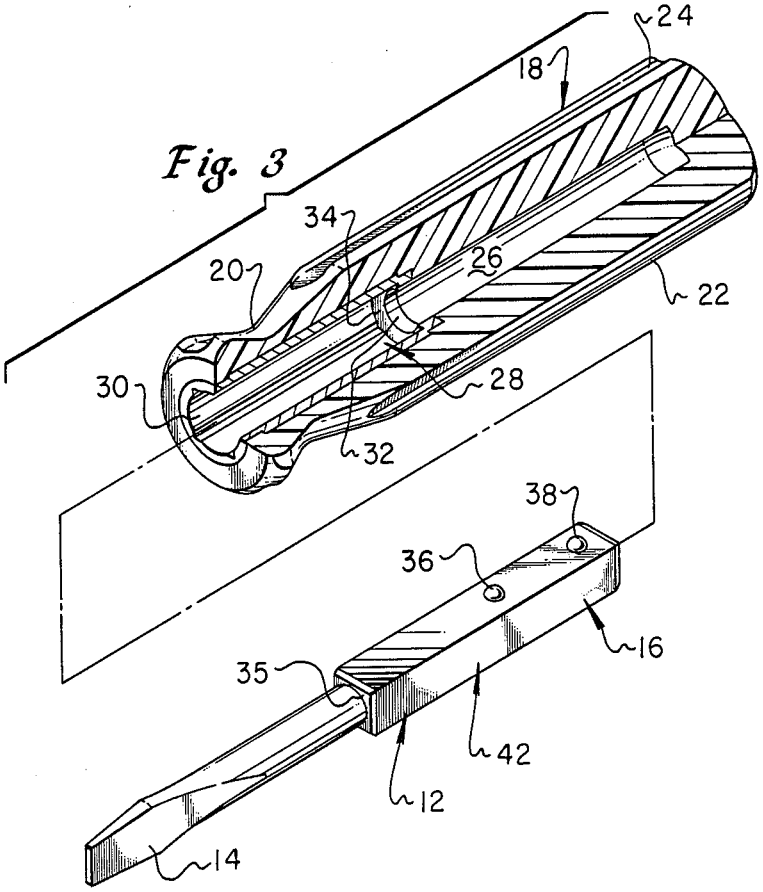
FIG. 3 is an exploded perspective view of the combination pocket tool shown in FIGS. 1 and 2.

The handle 18 has a longitudinally extending hollow cavity 26 for receiving the screwdriver blade 14 or the tool drive 16. The open end of the hollow cavity 26 is located in the neck portion 20 of the handle 18. The hollow cavity 26 must be of sufficient length to receive the screwdriver blade 14 when the screwdriver blade 14 is inserted into the cavity 26, as shown in FIG. 2.

A steel sleeve 28 is embedded in the hollow cavity 26 of the handle 18 and consists of an entry portion 30, a second portion 32, and a shoulder 34. The inner surface of the entry portion 30 is a non-circular opening to matingly receive the non-circular tool drive 16. The inner surface of the second portion 32 of the steel sleeve 28 is circular, having the same diameter as the remaining portion of the hollow cavity 26 of the handle 18 to receive the screwdriver blade 14.

The shoulder 34 is formed by the transition between the non-circular entry portion 30 and the circular second portion 32. The shoulder 34 provides a bearing surface for the tool drive 16 when the tool drive 16 is received within the cavity 26. A surface 35 on the shank 12 bears against the shoulder 34 when the tool 14 is received within the cavity 26.

A first detent 36 of a conventional type is located on the shank 12. The first detent 36 engages the sleeve 28 to secure the screwdriver blade 14 when the tool drive is received within the sleeve 28. When the shank 12 and the screwdriver blade 14 are received within the sleeve 28, the first detent 36 engages the sleeve 28 to secure the tool drive 16.

The tool drive 16 has a second detent 38, identical in construction to the first detent 36. The second detent 38 engages the sleeve 28 when the tool drive 16 is received within the cavity 26 of the handle 18 and assists the first detent 36 in securing the screwdriver blade 14 for use. When the screwdriver blade 14 is received within the cavity 26, the second detent 38 can be used to secure a detachable tool to the tool drive 16. The detachable tool 40 may be a standard socket 40.

In the preferred embodiment of the invention, the tool drive 16 is identical to the drive lug of a conventional ¼ inch drive socket wrench. The combination pocket tool 10 can thus be used as the drive for any of the numerous sockets typically comprising a ¼ inch drive socket set. A selected socket 40 is simply snapped onto the tool drive 16 when the screwdriver blade 14 is received within the cavity 26.

In operation, the combination pocket tool 10 is normally carried in the condition illustrated in FIG. 2. This is advantageous in that the overall length of the pocket tool 10 is substantially reduced when the screwdriver blade 14 is received within the cavity 26 of the handle 18. The pocket tool 10 is very convenient to carry in this manner and may be carried in a pants or coat pocket, or in a purse or brief case, with absolutely no danger of the tool snagging or otherwise damaging the garment in which it is carried. In this configuration, the tool drive 16 is available to receive any conventional ¼ inch drive socket.

When the screwdriver 14 is needed, the shank 12 is repositioned from the condition illustrated in FIG. 2 to the position illustrated in FIG. 1. In this position the first detent 36 and the second detent 43 secure the tool drive 16 in engagement with the sleeve 28 in the handle 18.

Only the preferred embodiment of the invention has been illustrated in the accompanying Drawings and described in the foregoing Detailed Description. The invention is not limited to the embodiment disclosed, but is intended to embrace any alternatives, modifications, rearrangements or substitutions of parts or elements as fall within the spirit and scope of the invention.

I claim:

1. A combination pocket tool comprising:

a shank;

a tool integrally formed on one end of the shank;

a tool drive integrally formed on the other end of the shank for receiving a detachable tool;

a handle having a longitudinally extending hollow cavity for selectively receiving the tool or the tool drive;

wherein said tool extending within said cavity and said tool drive extending outside of said cavity for use of said tool drive defines a first position of said shank, and said tool drive extending within said cavity and said tool extending outside of said cavity for use of said tool defines a second position of said shank;

first detent means on the shank for selectively securing the shank in said first position or in said second position and second detent means on the tool drive for aiding in securing the tool drive within the cavity when said shank is in said second position and for securing the detachable tool to the tool drive when said shank is in said first position.

2. A combination pocket tool as recited in claim 1, wherein the tool drive is a square socket drive.

3. A combination pocket tool as recited in claim 2, wherein the tool drive is dimensioned to drive a ¼ inch socket.

4. A combination pocket tool as recited in claim 1, wherein a sleeve is mounted in the cavity of the handle for selectively receiving the tool or the tool drive.

* * * * *